United States Patent [19]

Thumm

[11] 4,222,531

[45] Sep. 16, 1980

[54] WOOD PULPER WITH CONSTANT WOOD FEED

[75] Inventor: Helmut Thumm, Heidenheim, Fed. Rep. of Germany

[73] Assignee: J. M. Voith GmbH, Heidenheim, Fed. Rep. of Germany

[21] Appl. No.: 7,953

[22] Filed: Jan. 31, 1979

[30] Foreign Application Priority Data

Feb. 2, 1978 [DE] Fed. Rep. of Germany ..... 2804334

[51] Int. Cl.[3] ..... B02C 18/22

[52] U.S. Cl. ..... 241/281; 144/181; 144/246 R

[58] Field of Search ..... 241/280, 281; 198/608, 198/624; 144/181, 246 R, 246 F

[56] References Cited

U.S. PATENT DOCUMENTS

| | | | |
|---|---|---|---|
| 1,532,946 | 4/1925 | Rabus | 241/281 X |
| 1,615,530 | 1/1927 | White | 144/181 X |
| 3,000,411 | 9/1961 | Ealet | 144/181 X |
| 3,228,439 | 1/1966 | Jonsson et al. | 144/246 R UX |
| 3,844,399 | 10/1974 | Sellers et al. | 198/624 |

FOREIGN PATENT DOCUMENTS

| | | | |
|---|---|---|---|
| 1461582 | 1/1969 | Fed. Rep. of Germany . | |
| 2336350 | 2/1974 | Fed. Rep. of Germany | 241/280 |
| 2312013 | 9/1974 | Fed. Rep. of Germany . | |

*Primary Examiner*—Howard N. Goldberg
*Attorney, Agent, or Firm*—Albert L. Jeffers; John F. Hoffman

[57] ABSTRACT

The invention concerns a wood pulper of the kind in which wood is fed via a hopper having advancing elements arranged on two opposite sides by which wood is advanced to a grinding stone. The invention is characterized in that said advancing elements comprise a plurality of driven shafts which are arranged parallel to and adjacent each other substantially transverse to the feed direction, said shafts being equipped with a plurality of toothed discs lying adjacent to each other. This arrangement enables the driving force to be distributed over a plurality of feed shafts, so that a continuous compression can be obtained which increases as the wood feeds through the hopper.

8 Claims, 2 Drawing Figures

WOOD PULPER WITH CONSTANT WOOD FEED

BACKGROUND OF THE INVENTION

The present invention relates to a wood pulper of the kind in which wood is fed via a hopper having advancing elements arranged on two opposing sides by which the wood is advanced to a grinding stone.

A wood pulper of this kind is described, for example, in German Published Patent Specification No. 1,461,582. In this pulper, the wood is advanced to the grinding stone by advancing elements consisting of endless revolving contoured chains having projections thereon, which pick up a pile of wood and press it against the grinding stone. There is a difference in speed between the chain speed and the wood speed which increases with increasing compression towards to the surface of the grinding stone, however, and this results in an uneven compression of the wood and thus uneven loading of the contoured chain. Although virtually no force is expended by the contoured chain in the feed-in or starting zone of the hopper, the force expended rises approximately parabolically from approximately the center of the hopper onwards.

SUMMARY OF THE INVENTION

An object of the present invention is to provide an advancing device for a wood pulper, which achieves reliable and even compression of the wood, and which is trouble-free in operation.

The wood pulper according to the present invention is characterized in that the advancing elements comprise a plurality of driven shafts which are arranged parallel to and adjacent each other, substantially transverse to the feed direction, said shafts being equipped with a plurality of toothed discs lying adjacent to each other.

This characteristic feature enables the driving force to be distributed over a number of feed shafts, instead of only two as in the case of wood pulpers of the prior art. In this way, a continuous compression can be obtained, which increases evenly stepwise from the first shaft to the last. In addition, the feed device of the wood pulper according to the present invention can be made very robust and reliable in operation.

The drive motor and the mounting of the shafts can be arranged outside the hopper so as to protect these parts from chemical attack, and to enable maintenance to be carried out on them easily. Also, they can be replaced very rapidly, in a simple manner, if required.

Although a wood holder for long wooden beam cutters is already known from German Published Patent Specification No. 2,312,013, in which toothed discs are arranged on two opposing walls in a supply and feed hopper, in that case a different field of application is involved, and, in addition, the purpose of the application is different. Thus, in said German Specification No. 2,312,013 a machining appliance for long wooden beams is described, wherein the beams are cut by blades attached to a blade carrier, and the advance feed is effected by a pressing piston. On the two sides of the hopper, i.e. for engaging on the end faces of the wooden beams, there are several toothed discs. These toothed discs, which are not driven, are not used to advance the wood, but only serve to smooth out the feed speed or to hold the speed constant over the width of the hopper. They are provided to ensure that the cut pieces always have the same thickness across their width, and are also intended to prevent the wood from slipping or tipping when the blades are resting on it.

According to the present invention, provision is made for the shafts to be arranged in such a way that the toothed discs engage on the circumference of the pieces of wood. This feature is intended to provide a smooth advance by ensuring a trouble-free feeding, especially when the wood is of different lengths.

According to a further feature of the invention, provision can also be made for each of the shafts to be driven independently of each other. This feature makes it possible to continue to operate even when the drive for one shaft has failed. Moreover, if required, it is possible to operate at different rotary speeds, and therefore at different feed speeds and/or compression pressures.

It is advantageous if the toothed discs on adjacent shafts are arranged offset from each other in a direction transverse to the feed direction. This feature ensures that the toothed discs are arranged virtually alternately in interstices, which enables them to hold the wood even better. A further improvement in the feeding of the wood can be achieved if the toothed discs on shafts which lie opposite to each other are also offset from each other in a direction transverse to the feed direction.

According to a further feature, a pulp duct is located underneath the pulping zone, and a trough with a variable immersion depth is arranged underneath the grinding stone. In known wood pulpers, the wood pulp produced is removed via a collecting trough, but thickening often takes place in the trough, and the grinding stone becomes smeared. It is desirable for a continuous pulping process, however, that the surface of the stone should not become smeared. In accordance with this further feature, the trough is arranged in such a way that the wood pulp produced by the grinding stone is removed beforehand directly into a pulp duct, without further contact with the surface of the stone. The trough is thus used only to moisten the surface of the stone appropriately with water and/or suspension.

It is advantageous in this case for a water supply line to open out into the trough, which makes it possible to maintain the consistency in the trough so as to maintain the quality of the pulp constant. The effect on quality is obtained indirectly in this case, by means of the fiber/-water film carrier out of the trough by the surface of the stone. This ensures that the previously-selected constant conditions always prevail in the vicinity of the grinding zone. If required, production water, or pulp with a controlled consistency, can be supplied via the water supply line.

BRIEF DESCRIPTION OF THE DRAWINGS

One example of the invention will now be described with reference to the accompanying drawing in which.

DETAILED DESCRIPTION

Figure 2:
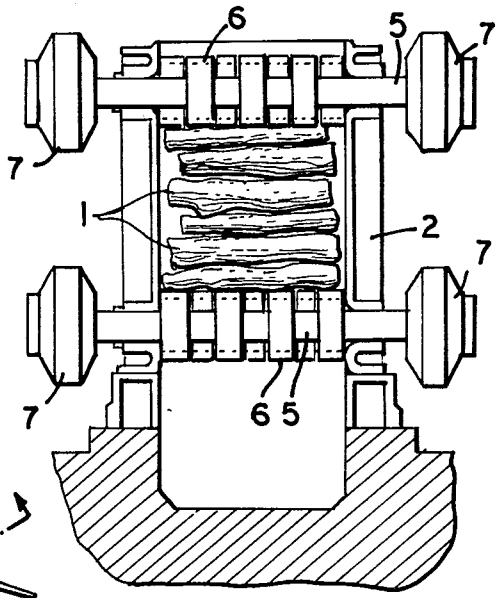
FIG. 2 is a section along line II—II in FIG. 1.

The wood 1 to be pulped is supplied via a hopper 2 with a feed aperture 3 to a grinding stone 4 of the wood pulper. The hopper 2 is equipped both on its upper face and on its opposed lower face with a number of shafts 5 arranged adjacent each other, on each of which a number of toothed discs 6 are arranged adjacent each other.

Figure 1:
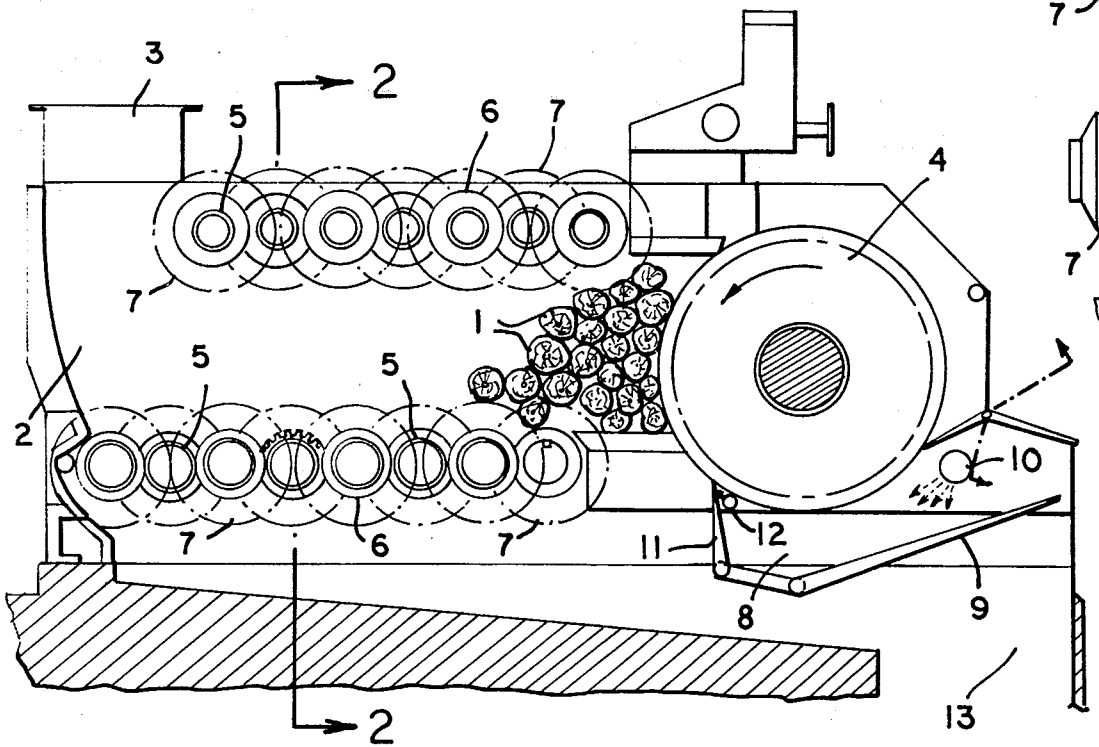
FIG. 1 is a longitudinal section through a wood pulper with the feed arrangement according to the invention.

The toothed discs 6 can be constructed as gear-wheels, discs with projections, cams, or the like. FIG. 1 illustrates a suitable prior art tooth structure on one of discs 6.

As shown in FIG. 2, the toothed discs 6 on adjacent shafts are offset from each other so that they engage in the intermediate spaces between the adjacent shafts. It can also be seen from FIG. 2 that the shafts which lie opposite to each other in the vertical direction are also equipped with toothed discs which are offset from each other. Each shaft 5 is equipped with one or two drive motors 7, preferably in the form of a hydraulic motor, although other types of motors may be used. For reasons of space, the drive motors 7 may be arranged at alternate ends of adjacent shafts.

Underneath the grinding stone, a trough 8 is located which is equipped with a flap 9, the height of which can be adjusted. The height of the flap 9 is chosen so that the immersion depth of the grinding stone 4 can be selected between zero and twenty centimeters. Furthermore, a water supply line 10 opens out into the trough 8, through which washing water or a suspension can be supplied for the controlled adjustment of the stock density in the trough 8. A wiper blade 11, which can be combined with a spray tube 12, is used to wipe off any wood pulp which might possibly adhere to the grinding stone in the pulping zone, from which the wood pulp feeds into a pulp duct 13.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. A wood pulper comprising: a pulp trough, a grinding element positioned over said pulp trough, a feed zone in front of said grinding element, a plurality of substantially parallel shafts mounted in said feed zone, said shafts being arranged in at least two sets which are spaced from each other and located on respective opposite sides of the feed zone, a plurality of drive means for rotating the shafts of each group, said drive means being independently controlled and independently connected respectively to at least some of said shafts, a plurality of toothed discs mounted on and driven by each of said shafts, said shafts and toothed discs defining a feed direction generally perpendicular to said shafts, the toothed discs of adjacent said shafts in each group being staggered relative to each other in a direction substantially perpendicular to the feed direction.

2. The wood pulper of claim 1 wherein the circumferential surfaces of said toothed discs thereof are adapted for seizing the wood to be pulped as they rotate.

3. The wood pulper of claim 1 or 2 wherein certain ones of the shafts in one of the groups lie generally opposite respective ones of the shafts in the other group, and wherein the toothed discs on shafts lying opposite one another are staggered relative to each other in a direction opposite the feed direction.

4. The wood pulper of claim 3 including a material duct underneath said grinding element and said pulp trough has a variable immersion depth, said grinding element is partially disposed in said trough.

5. The wood pulper of claim 4 including water supply pipe means emptying into said trough for feeding said trough with water.

6. The wood pulper of claim 1 or 2 including a material duct underneath said grinding element and a variable immersion depth trough underneath said grinding element, said grinding element being partially disposed in said trough.

7. The wood pulper of claim 6 including water supply pipe means emptying into said trough for feeding said trough with water.

8. The wood pulper of claim 1 wherein said drive means comprises individual drive motors.

* * * * *